US006293850B1

(12) United States Patent
Lin et al.

(10) Patent No.: US 6,293,850 B1
(45) Date of Patent: Sep. 25, 2001

(54) CHEMICAL-MECHANICAL POLISH MACHINES AND FABRICATION PROCESS USING THE SAME

(75) Inventors: Juen-Kuen Lin, Kaohsiung; Chien-Hsin Lai, Kaohsiung Hsien; Peng-Yih Peng, Hsinchu; Kun-Lin Wu, Taichung; Daniel Chiu, Hsinchu Hsien; Chih-Chiang Yang, Hsinchu; Juan-Yuan Wu; Hao-Kuang Chiu, both of Hsinchu, all of (TW)

(73) Assignee: United Microelectronics Corp., Hsinchu (TW)

( * ) Notice: Subject to any disclaimer, the term of this patent is extended or adjusted under 35 U.S.C. 154(b) by 0 days.

(21) Appl. No.: 09/426,937

(22) Filed: Oct. 22, 1999

Related U.S. Application Data

(60) Division of application No. 09/157,041, filed on Sep. 18, 1998, which is a continuation-in-part of application No. 09/059,750, filed on Apr. 18, 1998, and a continuation-in-part of application No. 08/959,158, filed on Oct. 28, 1997, now Pat. No. 5,944,593.

(30) Foreign Application Priority Data

Sep. 1, 1997 (TW) ..... 86214921
Dec. 1, 1997 (TW) ..... 86118024

(51) Int. Cl.[7] ..... B24B 1/00

(52) U.S. Cl. ..... 451/41; 451/60; 451/287; 451/285; 451/397; 451/388; 451/446

(58) Field of Search ..... 451/60, 287, 285, 451/397, 388, 446

(56) References Cited

U.S. PATENT DOCUMENTS

| | | | | |
|---|---|---|---|---|
| 2,883,802 | | 4/1959 | Katzke . | |
| 3,375,614 | | 4/1968 | Boettcher et al. . | |
| 4,679,359 | | 7/1987 | Suzuki . | |
| 4,738,056 | | 4/1988 | Suzuki . | |
| 4,739,589 | | 4/1988 | Brehm et al. . | |
| 5,032,203 | | 7/1991 | Doy et al. . | |
| 5,232,875 | | 8/1993 | Tuttle et al. . | |
| 5,597,346 | * | 1/1997 | Hempel, Jr. | 451/287 |
| 5,643,061 | | 7/1997 | Jackson et al. . | |
| 5,695,392 | * | 12/1997 | Kim | 451/288 |
| 5,725,420 | | 3/1998 | Torii . | |
| 5,738,573 | | 4/1998 | Yueh . | |
| 5,749,771 | | 5/1998 | Isobe . | |

FOREIGN PATENT DOCUMENTS

| | | | | |
|---|---|---|---|---|
| 0 737 546 A2 | | 10/1996 | (DE) . | |
| 2315694 | * | 11/1988 | (GB) | B24B/37/04 |
| 2 292 254 | | 2/1996 | (GB) . | |
| 2 315 694 | | 2/1998 | (GB) . | |
| 58-154051 | | 10/1983 | (JP) . | |
| 63-283859 | | 11/1988 | (JP) . | |
| 1-34661 | | 2/1989 | (JP) . | |
| 5-4165 | | 1/1993 | (JP) . | |
| 06151393 | | 5/1994 | (JP) . | |
| 06333891 | | 12/1994 | (JP) . | |
| 0 623 949 A1 | | 11/1994 | (SE) . | |

* cited by examiner

*Primary Examiner*—Stephen F. Gerrity
*Assistant Examiner*—Shantese McDonald
(74) *Attorney, Agent, or Firm*—Thomas, Kayden, Horstemeyer & Risley

(57) ABSTRACT

A chemical mechanical polishing machine and a fabrication process using the same. The chemical mechanical polishing machine comprises a retainer ring having a plurality of slurry passages at the bottom of the retainer ring. The retainer ring further comprises a circular path. By conducting the slurry through the slurry passages and the circular, a wafer is planarized within the chemical mechanical polishing machine.

13 Claims, 15 Drawing Sheets

Average : 7245.58Å Range : 2374.40Å Scan Direction : Horizontal

Standard : 366.32 Å(5.06 %) Center Position : (0.000,0.000) mm

Average : 7001.46Å Range : 293.92Å Scan Direction : Horizontal

Standard : 64.15 Å(0.92 %) Center Position : (0.000,0.000) mm

Average : 6960.89Å Range : 687.33Å Scan Direction : Horizontal

Standard : 128.37 Å(1.84 %) Center Position : (0.000,0.000) mm

CHEMICAL-MECHANICAL POLISH MACHINES AND FABRICATION PROCESS USING THE SAME

CROSS-REFERENCE TO RELATED APPLICATION

This application is a divisional application of U.S. patent application Ser. No. 09/157,041, filed Sep. 18, 1998 which is a continuation in part of U.S. application Ser. No. 08/959,518, filed Oct. 28, 1997 and U.S. application Ser. No. 09/059,750, filed Apr. 14, 1998. All of these applications are incorporated herein by reference.

BACKGROUND OF THE INVENTION

1. Field of the Invention

This invention relates to semiconductor fabrication technologies, and more particularly, to an improved structure for the retainer ring used on the polishing head of a chemical-mechanical polish (CMP) machine to retain a semiconductor wafer in position while performing the CMP process.

2. Description of Related Art

In semiconductor fabrications, the chemical-mechanical polish (CMP) technique is widely used for the global planarization of semiconductor wafers that are used for the fabrication of VLSI (very large-scale integration) and ULSI (ultra large-scale integration) integrated circuits.

FIGS. 1A and 1B are schematic diagrams showing a conventional CMP machine. The CMP machine comprises a polishing table 10 on which a polishing pad 12 is layered, a polishing head 14 for holding a semiconductor wafer 16 in position, and a nozzle 18 for applying a mass of slurry to the semiconductor wafer 16 during the CMP process.

FIG. 1C shows a respective view of the structure inside of the polishing head 14. As shown, the polishing head 14 includes an air-pressure means 20 which applies air pressure to a wafer loader 22 used to hold the wafer 16. In addition, a retainer ring 24 is mounted around the loader 22 and the wafer 16, which can retain the wafer 16 in fixed position during the CMP process. Moreover, a cushion pad (not shown) is placed between the wafer 16 and the loader 22.

FIGS. 2A–2B show a conventional structure for the retainer ring 24. Through the retainer ring structure of FIGS. 2A–2B, the slurry is supplied for polishing under the polishing head 14, that is, over the surface of a wafer to be polished. However, without a proper conduit or passage of the retainer head, the slurry is non-uniformly distributed over the surface of the wafer. It is found that the slurry can not circulating fluently over the wafer surface. Thus, drawbacks such as a large wafer-edge exclusion range, a low refuse removing rate, an inefficient use of the slurry, and a reduced life of use of the cushion pad are caused. The resultant surface flatness of the wafer after undergoing a CMP process using the retainer ring of FIGS. 2A–2B is shown in FIG. 3. The graph of FIG. 3 shows the thickness of the wafer in relation to the various points of a straight line passing through the spinning center of the wafer. From the plot shown in FIG. 3, it can be seen that the flatness is not quite satisfactory. The standard deviation of the thickness data is about 5.06%.

SUMMARY OF THE INVENTION

It is therefore an objective of the present invention to provide a new retainer ring for used on the polishing head of a CMP machine. The new retainer ring in the CMP machine allows the slurry supplying more uniformly over the surface of a wafer. Thus, the above mentioned problems by using the conventional CMP machine, such as a large wafer-edge exclusion range, a low refuse removing rate, an inefficient use of the slurry, and a reduced life of use of the cushion pad, are solved.

It is another objective of the invention to provide a fabrication process for a wafer. The wafer is planarized by CMP method using the CMP machine with a new retainer ring to obtain a much improved flatness is obtained.

In accordance with the foregoing and other objectives of the present invention, a retainer ring for used on the polishing head of a CMP machine is provided. The retainer ring comprises a plurality of slurry passages formed at the bottom edge of the retainer ring. The slurry passages are substantially equally spaced, and each of the slurry passages is radially inclined in such a manner to form an acute angle of attack against the slurry outside of the retainer ring when the retainer ring spins.

In accordance with a first embodiment of the invention, a retainer ring is formed with a plurality of straight grooves equally spaced around the bottom of the retainer ring. Each of the straight grooves is radially inclined in such a manner so as to form an acute angle of attack against the slurry on the outside of said retainer ring when said retainer ring spins.

In accordance with a second embodiment of the invention, the retainer ring further comprises a circular path at the bottom between the inner perimeter and the outer perimeter of the retainer ring. The equally spaced arrangement of the straight grooves causes the slurry to be drawn into the inside of the retainer ring from all radial directions, thus allowing the slurry to be spread uniformly over the wafer held on the inside of the retainer ring. Furthermore, the provision of the circular path allows the slurry buffered by and circulating in, thus allowing those edge portions of the wafer proximate to the inner ends of the straight grooves to receive a buffered flow of slurry.

In the third embodiment, the slurry passages are designed with a gradually expanding path for slurry from an inlet to an outlet thereof, a diffusion angle between 0° to 10°, and an angle of attack $\phi_1$ calculated from the equation:

$$\sin\phi_1 = \frac{x}{l}$$

wherein the x is the minimum distance between a tangent line of an inlet point and a tangent line of an outlet point, and l is a path length of each of the slurry passages.

In the fourth embodiment, the retainer ring is formed with a combination of the slurry passages in the second embodiment and the circular path in the second embodiment.

To achieve the objectives of the invention, a fabrication process is also provided. To planarize a wafer having a deposition layer thereon, the wafer is disposed within a polishing head with the deposition layer facing down the polishing table. The wafer is retained within the polishing head by a retainer ring, and the retainer ring comprises a plurality of slurry passage. A slurry is supplied from a slurry supplier to be evenly distributed over the deposition layer through the retainer ring. The polishing is rotating and the polishing head is spinning to achieve the objective and the invention, a fabrication process is also provided.

In another embodiment, a chemical mechanical process is provided. A deposition layer is formed on a wafer. A chemical mechanical process is performed to the deposition layer using a chemical mechanical polishing machine with a retainer ring having a plurality of slurry passages at the bottom thereof.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

In accordance with the invention, an improved structure of a retainer ring is provided. The improved structure of the retainer ring enables the slurry supplied for polishing the wafer evenly distributed over the wafer. A first embodiment of the invention is described in the following with reference to FIGS. 4A–4B.

First Embodiment

Figure 4A:
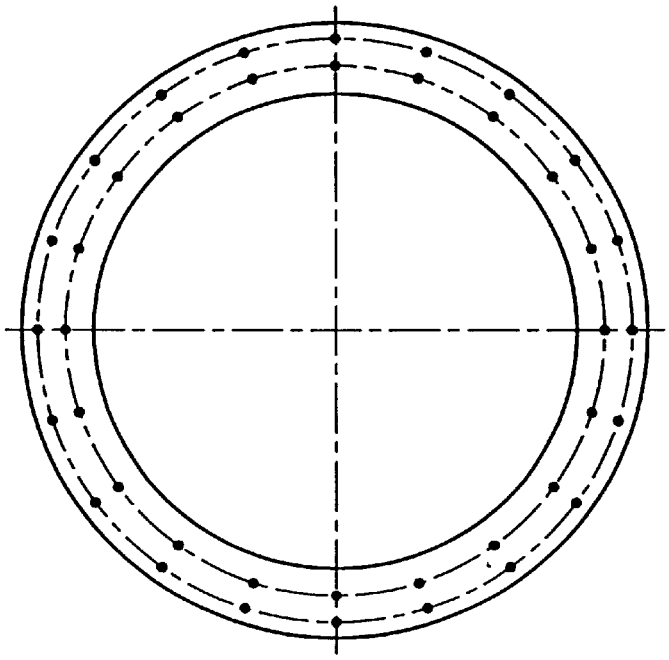
FIG. 4A is a schematic top view of a first embodiment of the retainer ring according to the invention.
Figure 4B:
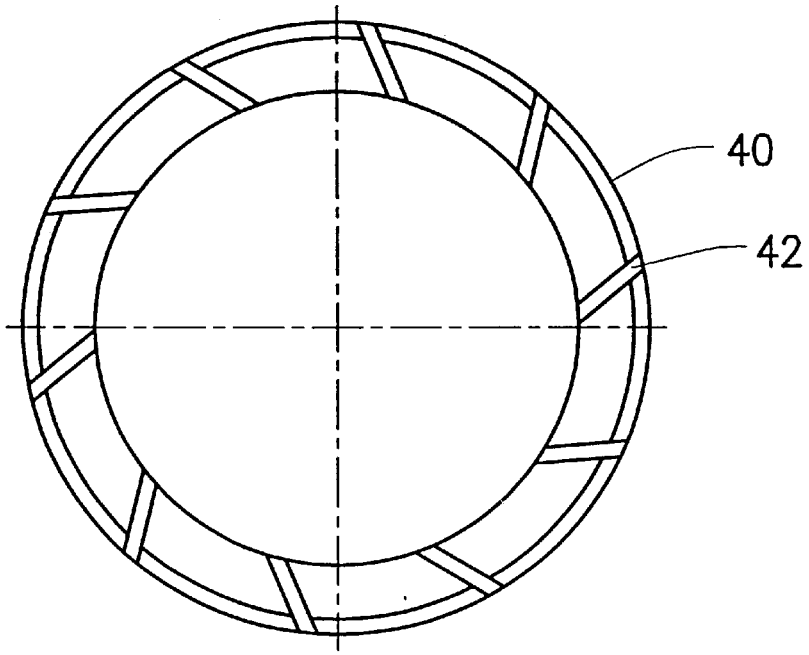
FIG. 4B is a schematic bottom view of the retainer ring of FIG. 4A.

FIG. 4A is a schematic top view of the retainer ring 40 in the first embodiment according to the invention, and FIG. 4B is a schematic bottom view of the retainer ring 40 shown in FIG. 4A. The inner diameter of the retainer ring 40 is ranged from 4 in. (inch) to 12 in., or even larger 12 in. However, since the retainer ring 40 is functioned to retain a semiconductor wafer during the CMP process, therefore, the actual inner diameter of the retainer 40 depends on the size of the wafer to be polished. As shown in FIG. 4B, the retainer ring 40 is formed with a plurality of slurry paths, passages or conduits 42. The slurry passages 42 can be formed as grooves under the retainer ring, channels or tubes through the retainer rings, or recesses in other shape. In this embodiment, straight grooves spaced at substantially equal angular intervals around the retainer ring 40 are employed. Each of these slurry passages 42 is oriented at an angle with respect to the radius in such a manner that its outer end leads its inner end in angular position in reference to the spinning direction of the retainer ring 40. That is, the slurry passages are radially declined. While performing a polishing process, the retainer ring 40 is spinning with a speed as required, these slurry passages 42 are oriented with an acute angle of attack against the slurry supplying from outside of the retainer ring 40. Thus the slurry is circulating fluently over the surface of the wafer inside the retainer ring 40 by supplying through the retainer ring 40 with the aid of the slurry passages 42. In the case of FIG. 4B, for example, the orientation of the straight grooves 42 shows that the retainer ring 40 is to be spinning in the counterclockwise direction. It is appreciated that persons skilled in the art could rearrange the slurry passages 42 in another way that the retainer ring 40 would be spinning in the clockwise direction during polishing. In this embodiment, each of the slurry passages 42 has a width of 0.05~0.3 mm (millimeter) and a depth of 2~4 mm. The actual width and depth of these slurry passages should be different according to the specific requirements for the polishing process. The manner of equally spacing the slurry passages 42 enables the slurry to be drawn inside the retainer ring 40 with a substantially equal amount from all radial directions, thus allowing the slurry to be spread uniformly over the surface of the wafer.

Figure 1A:
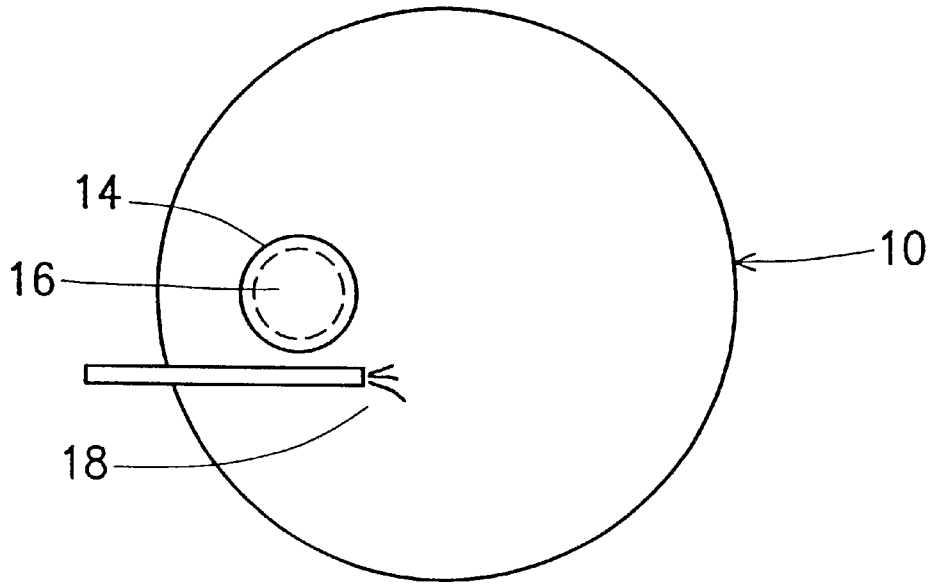
FIG. 1A (PRIOR ART)
FIG. 1A is a schematic top view of a CMP machine for performing a CMP process on a semiconductor wafer.
Figure 1B:
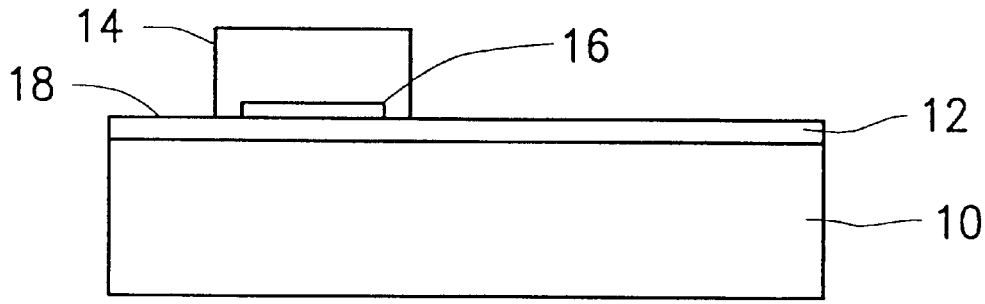
FIG. 1B (PRIOR ART)
FIG. 1B is a schematic sectional view of the CMP machine of FIG. 1A.
Figure 1C:
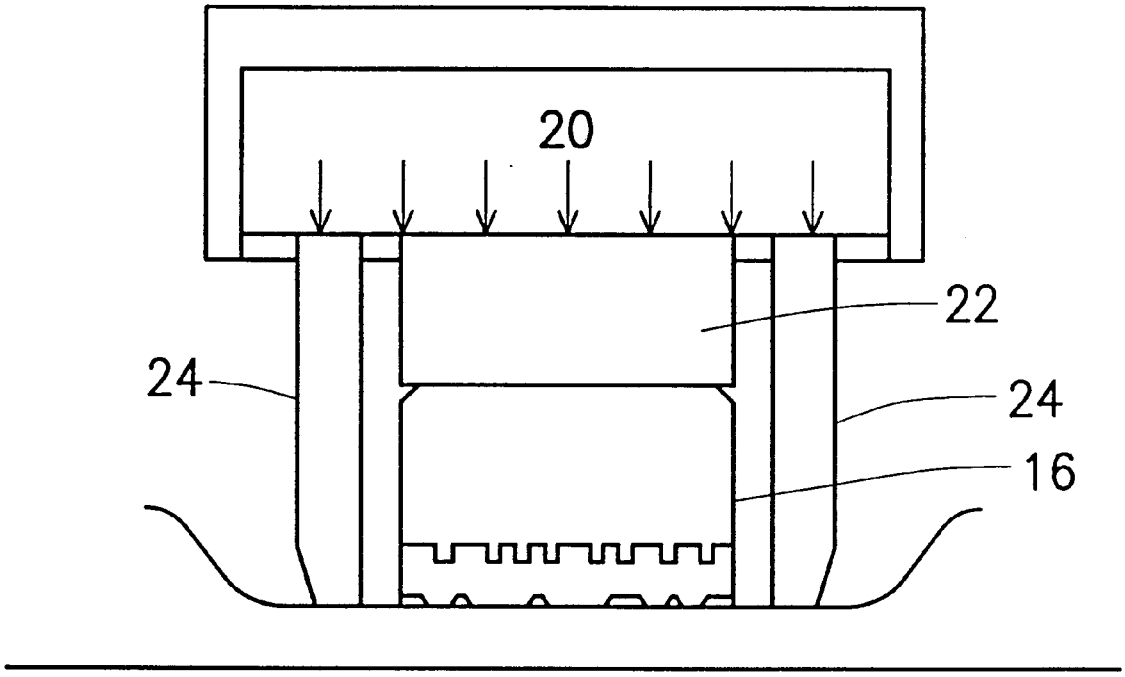
FIG. 1C (PRIOR ART)
FIG. 1C is a cross-sectional view showing a detailed inside structure of the polishing head used on the CMP machine of FIGS. 1A and 1B.
Figure 2A:
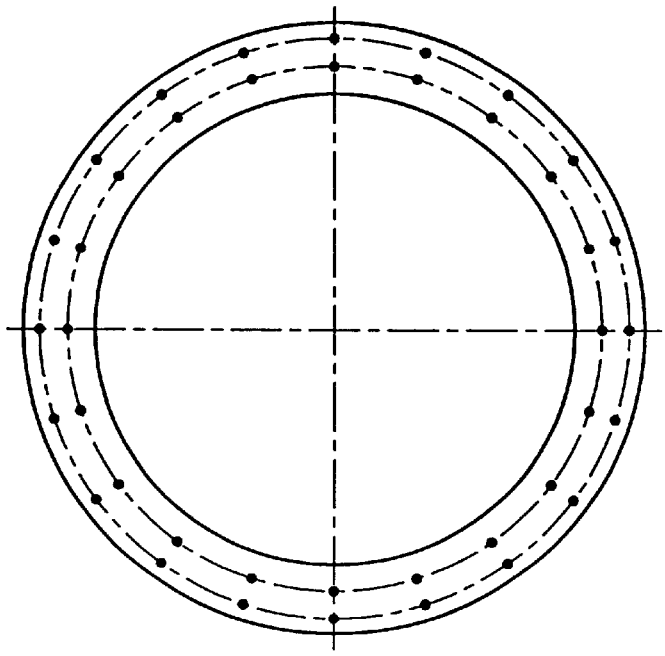
FIG. 2A (PRIOR ART)
FIG. 2A is a schematic top view of a conventional retainer ring used on the polishing head of FIG. 1C.
Figure 2B:
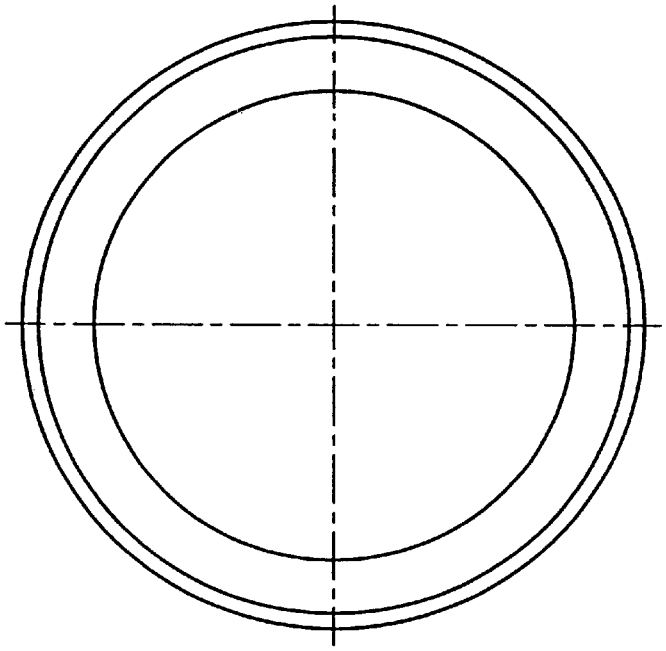
FIG. 2B (PRIOR ART)
FIG. 2B is a schematic bottom view of the conventional retainer ring of FIG. 2A.
Figure 3:
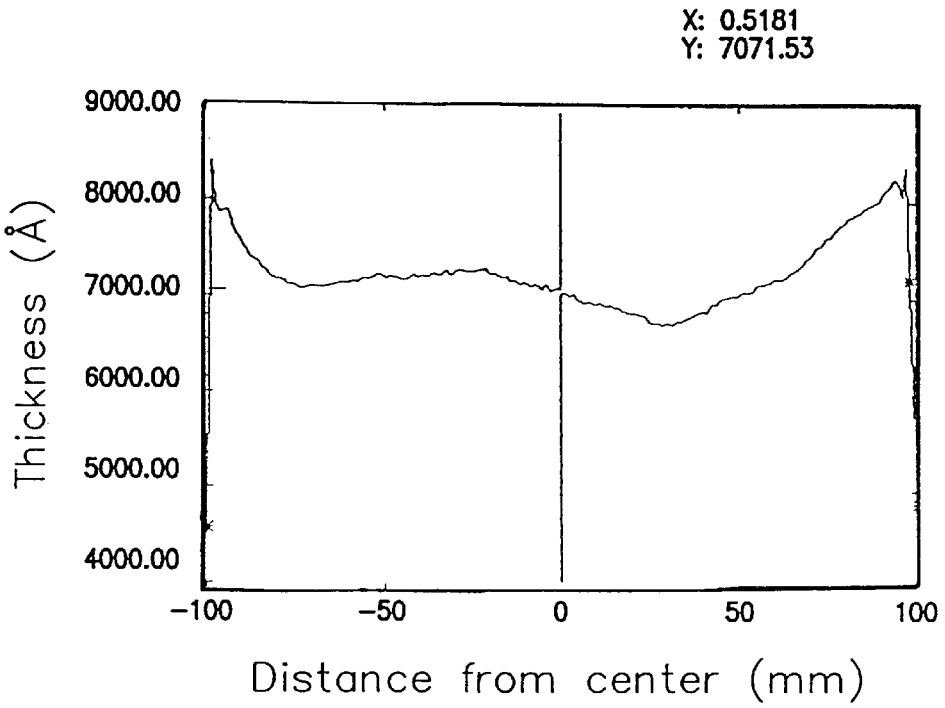
FIG. 3 (PRIOR ART)
FIG. 3 is a graph, showing the resultant flatness of the semiconductor wafer after undergoing a CMP process using the conventional retainer ring of FIGS. 2A–2B.
Figure 6:
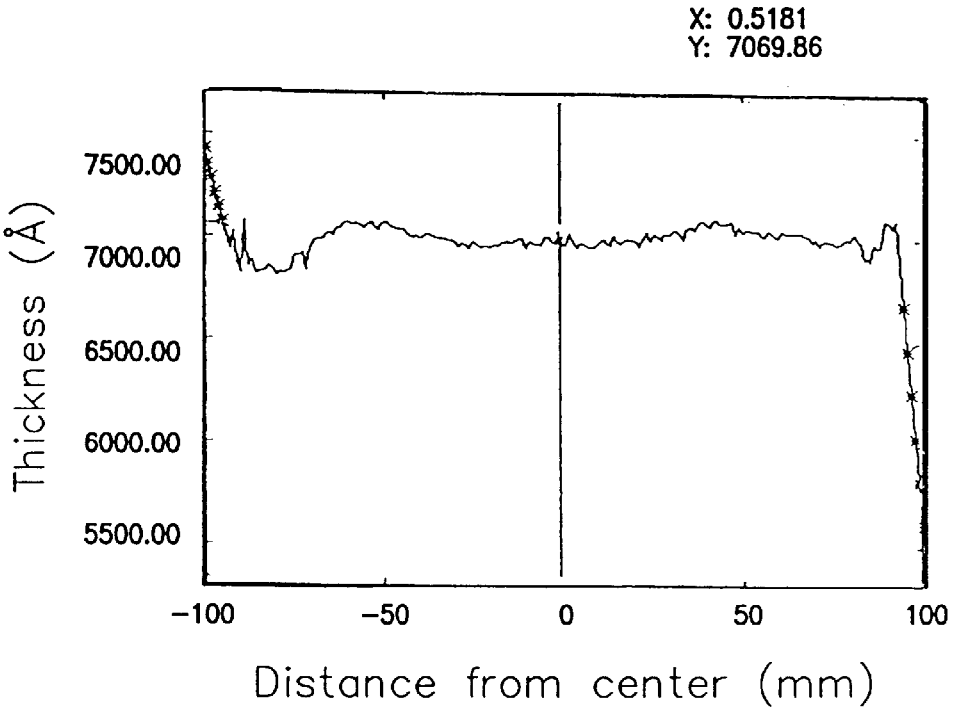
FIG. 6 is a graph, showing the resultant flatness of the semiconductor wafer after undergoing a CMP process using the retainer ring of FIGS. 4A–4B.
Figure 7:
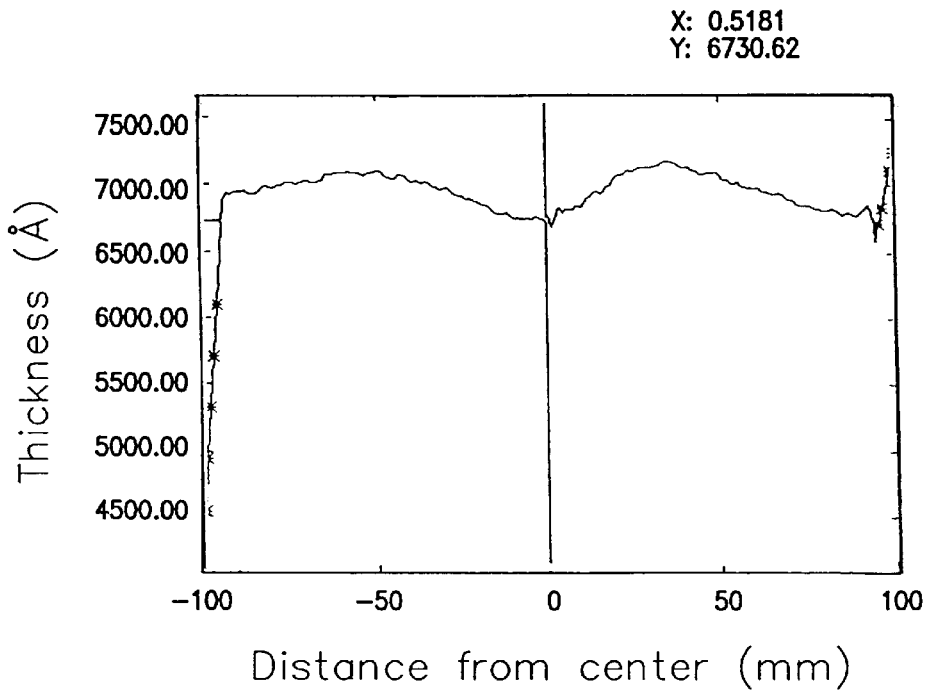
FIG. 7 is a graph, showing the resultant flatness of the semiconductor wafer after undergoing a CMP process using the retainer ring of FIGS. 4A–4B.

The resultant flatness of a wafer after undergoing a CMP process using the retainer ring of FIGS. 4A–4B is shown in FIG. 6 and FIG. 7. The flatness is measured in terms of the thickness values along a straight line passing through the center of the wafer. From the graphs of FIG. 6 and FIG. 7, it is seen that the flatness of the wafer samples is significantly better than the flatness of the wafer shown in FIG. 3 by using the prior art retainer ring of FIGS. 2A–2B. The standard deviation of thickness is 0.92% in the case of FIG. 6 and 1.38% in the case of FIG. 7, which are both significantly better than the standard deviation of 5.06% in the case of FIG. 3. However, as shown in FIG. 7, since the edge portions of the wafer proximate to the inner ends of the slurry passages 42 would receive the greatest amount of slurry than other portions of the wafer, the polishing effect is much significant than other portions. Consequently, the thickness of the edge portions proximate to the slurry passages is significantly less than that of other portions of the wafer.

Second Embodiment

Figure 5A:
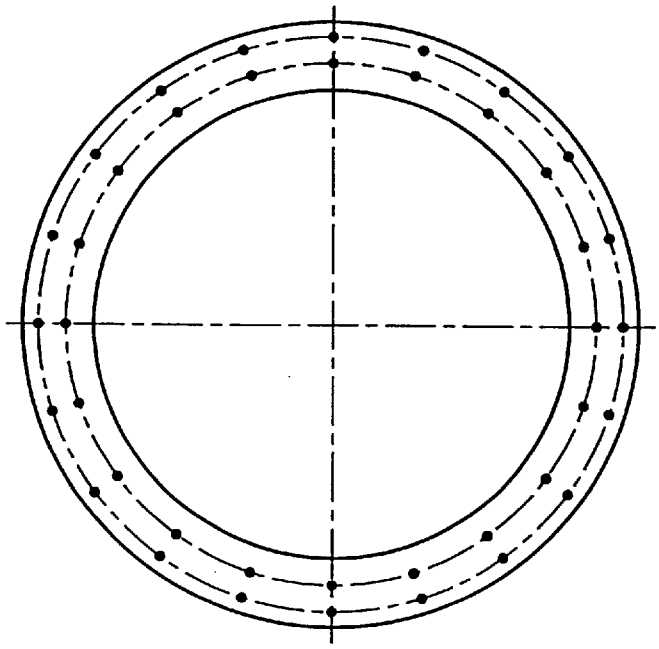
FIG. 5A is a schematic top view of a second embodiment of the retainer ring according to the invention.
Figure 5B:
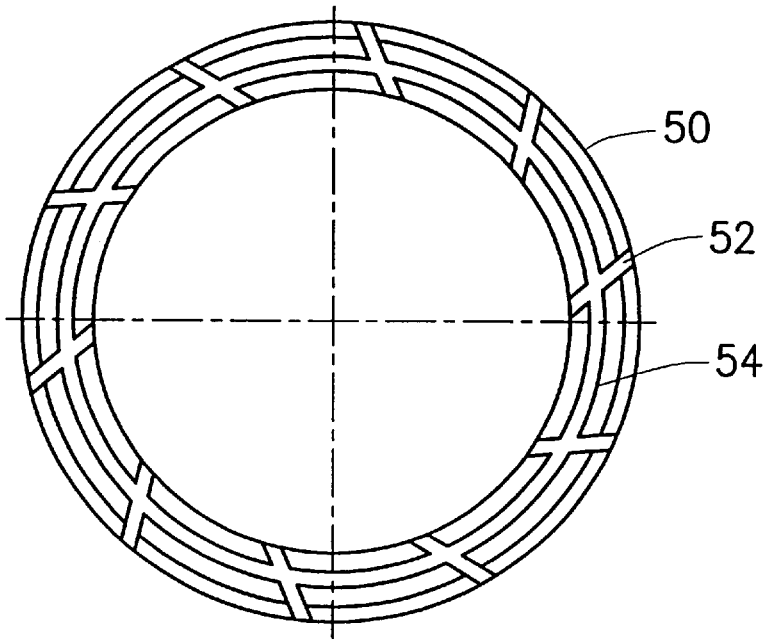
FIG. 5B is a schematic bottom view of the retainer ring of FIG. 5A.

FIG. 5A is a schematic top view of the second embodiment of the retainer ring 50 according to the invention, and FIG. 5B is a schematic bottom view of the retainer ring 50 shown in FIG. 5A.

As shown in FIG. 5B, the design of the slurry passages 52 of the retainer ring 50 in this embodiment is identical to the previous embodiment. That is, these slurry passages 52 are in a form of substantially equally spaced straight grooves.

Each of these slurry passages 52 is oriented in a similar manner as the previous embodiment and formed similarly with a width of 0.1 mm and a depth of 2~4 mm. Again, the width and depth of the slurry passages 52 depends on the specific requirements for the polishing process. In his embodiment, at least one circular recessed ring 54, for example, a circular groove, is formed at the bottom surface of the retainer ring 50 between the outer perimeter and inner perimeter of the retainer ring 50, intercrossing all of the straight grooves 52. The circular recessed ring 54 is functioned as a buffer ring. The slurry being drawn in through the slurry passages 52 is partly buffered and circulating in the circular recessed ring 54, thus allowing those edge portions of the wafer proximate to the inner ends of the slurry passages 52 to receive only a part of the slurry. Thus, the polished effect obtained from the previous embodiment, that is, an evenly and uniformly planarized surface of the wafer, is obtained without forming thinner edge portions. The circular recessed ring 54 has a similar dimension of the slurry passages 52, that is, a width of about 0.05~0.3 mm and a depth of about 2~4 mm.

The above two embodiments consider in a qualitative point of view. With the formation of the slurry passages, or even with the buffer circular groove intercross the slurry passages, a much better planarized effect is achieved. However, in the above embodiments, the parameters which such as the detailed shape of the slurry passages, the angle of attack, that is, the angle between the central line of the slurry passage and the tangent line, and the diffusion angle are never discussed. In the following embodiments, a quantitative point of view is taken. The parameters determining the slurry flow are considered.

Third Embodiment

Figure 8A:
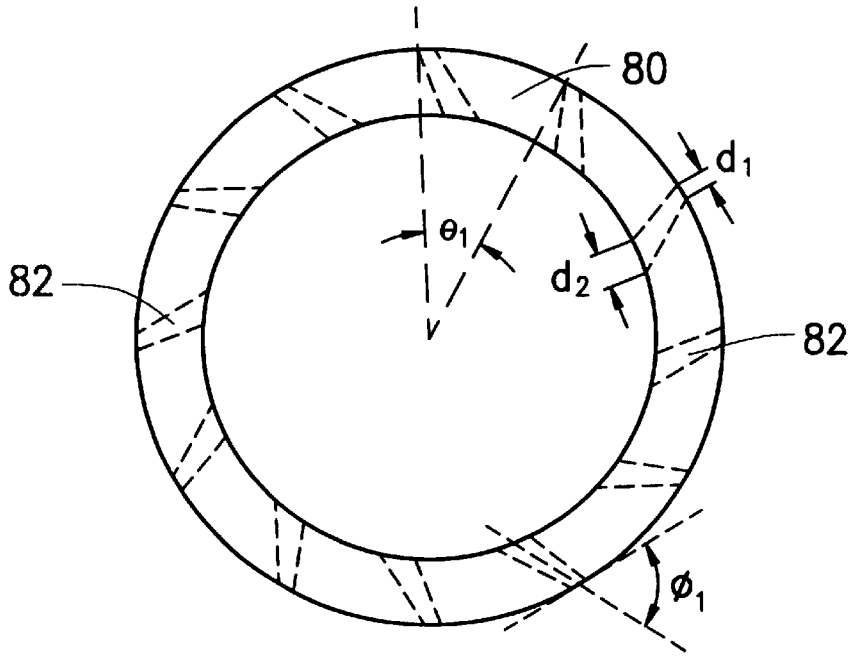
FIG. 8A and FIG. 8B are a top view and a side view of a retainer ring in a third according to the invention.
Figure 8B:
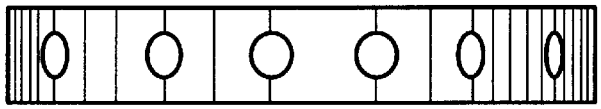

A schematic top view of a retainer ring is shown as FIG. 8A. In this embodiment, twelve slurry passages 82 are formed at the bottom of the retainer ring 80. It is appreciated that persons skilled in the art may select a different number of the slurry passages according to specific requirements during for certain polishing process. Consider a retainer ring 80 with an outer diameter of 25.40 cm and an inner diameter of 22.86 cm, the width of the retainer ring 80 is thus 25.40 cm−22.86 cm=2.54 cm. The formation of the slurry passages 82 enables the slurry flow into the retainer ring and distributed over the surface of the wafer to be polished. As mentioned above, the slurry passages 82 can be in a formed of tubes, grooves, channels, or guiding holes penetrating though the whole width of the retainer ring 80. The central angle between two consecutive (two neighboring) slurry passages 82 is denoted as $\theta_1$, and the angle of attack of each slurry passage 82 is denoted as $\phi_1$. Assuming the diameter of the inner end of the slurry passage 82 is $d_2$, whereas the outer one is $d_1$. FIG. 8B shows a schematic side view of the retainer ring 80 with the slurry passages 82 in a form of guiding holes.

Drawing a central line through the center points of one slurry passage 82, a diffusion angle $\phi_2$ is defined as the angle between the central line and one perimeter of the slurry passage 82.

Figure 8C:
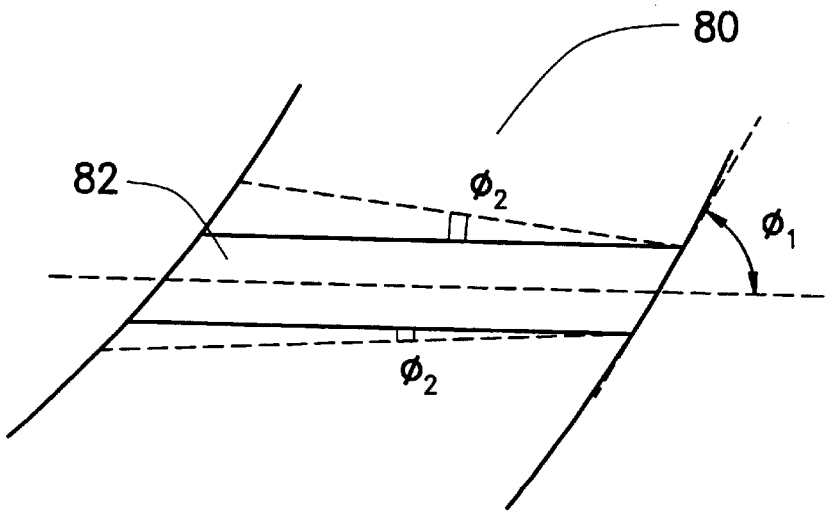
FIG. 8C is a schematic cross section view of the slurry passage.
Figure 9A:
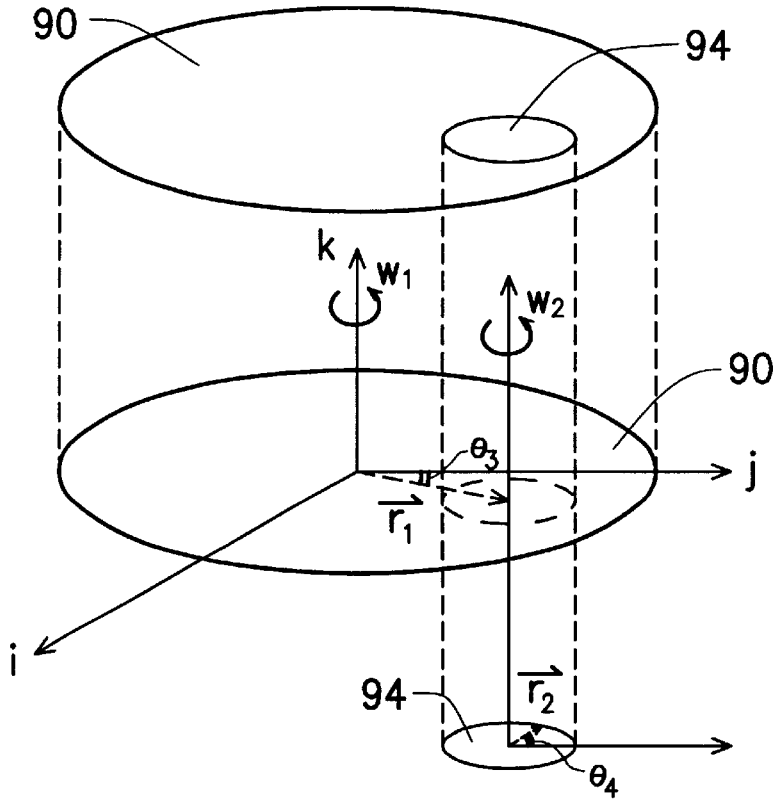
FIG. 9A to FIG. 9D shows the mechanism of the slurry flow.

FIG. 9A to FIG. 9D illustrates the mechanism of the polishing process using the retainer ring 80 shown in FIG. 8A to FIG. 8C. Assuming the polishing table 90 is rotating with an angular velocity $\vec{\omega_1}$ and the distance between the center of the polishing table 90 and the center of the polishing head 94 is $\vec{r_1}$. Whereas, the polishing head 94 is spinning with an angular velocity $\vec{\omega_2}$ with a radius of $\vec{r_2}$. As shown in FIG. 9A, if the angle between $\vec{r_1}$ and the j-axis is $\theta_3$ and the angle between $\vec{r_2}$ and the j-axis is $\theta_4$, any point at the perimeter of the polishing head 90 is thus rotating with a velocity $\vec{V_h}$. The velocity can thus be calculated as:

$$\begin{aligned}\vec{V_h} &= \vec{\omega_1}\times(\vec{r_1}+\vec{r_2}) + \vec{\omega_2}\times\vec{r_2} \\ &= (r_1\omega_1\cos\theta_3 + r2\omega_1\cos\theta_4 + r_2\omega_2\cos\theta_4)i - \\ &\quad (r_1\omega_1\sin\theta_3 + r_2\omega_1\sin\theta_4 + r_2\omega_2\sin\theta_4)j \\ &= Ai + Bj\end{aligned} \tag{1}$$

Figure 9B:
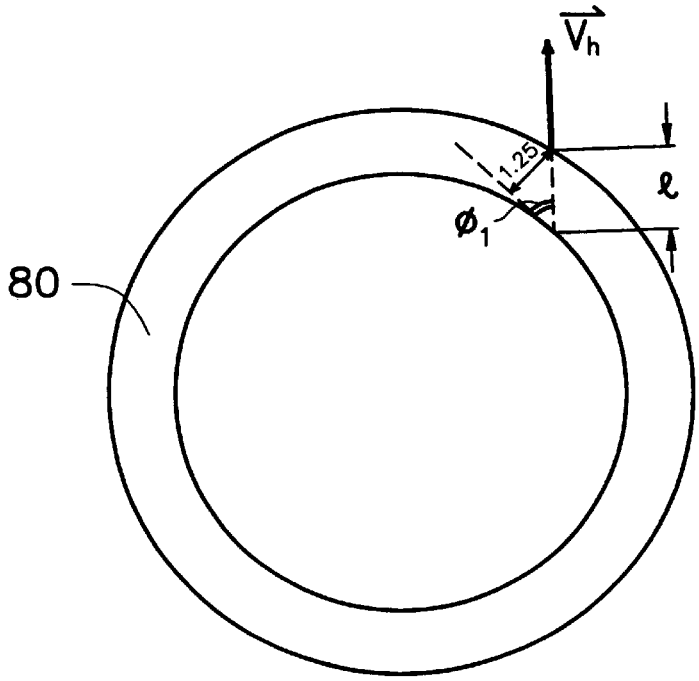

FIG. 9B shows the movement of the retainer ring 80. It is to be noted that the movement the retainer ring 80 is synchronous to the polishing head 94 shown in FIG. 9A. Considering forming the slurry passages with its central line along the direction of the velocity of the retainer ring 80, from the above equation, the direction of the velocity $\vec{V_h}$ is, that is, the angle of attack of the slurry passage:

$$\phi_1 = \tan^{-1}\frac{A}{B} \tag{2}$$

For a retainer ring 80 having a minimum distance of 1.25 cm between the tangent line of the inlet point and the tangent line of the outlet point, and a length of the slurry passage of l;

$$\sin\phi_1 = \frac{1.25}{l} \tag{3}$$

The slurry passage can thus be designed according to the parameters derived from the above relations.

Figure 9C:
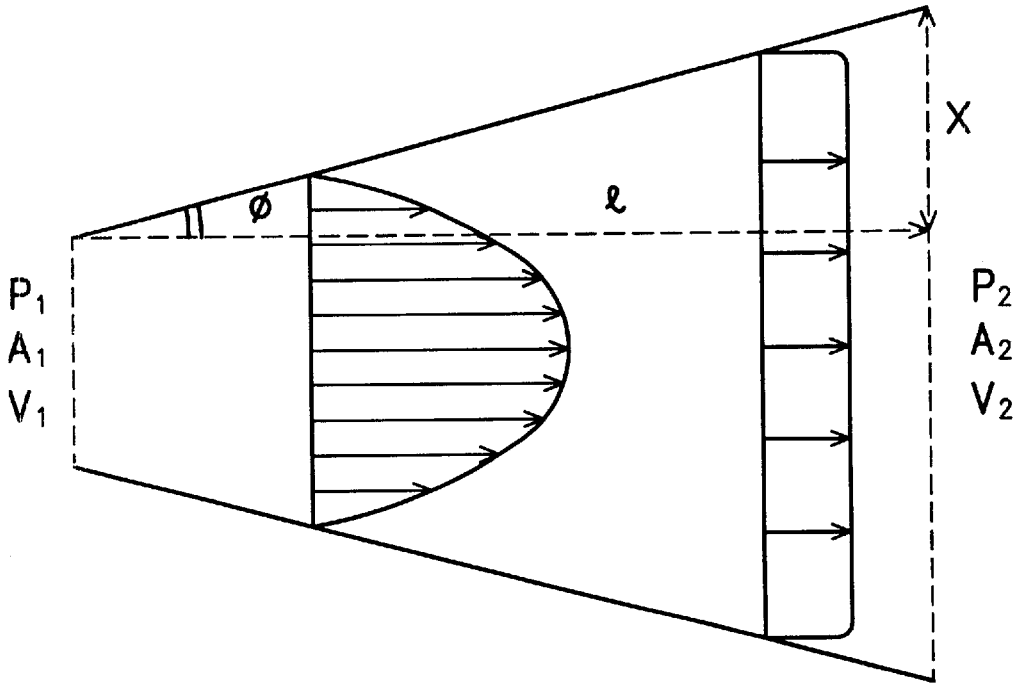
Figure 9D:
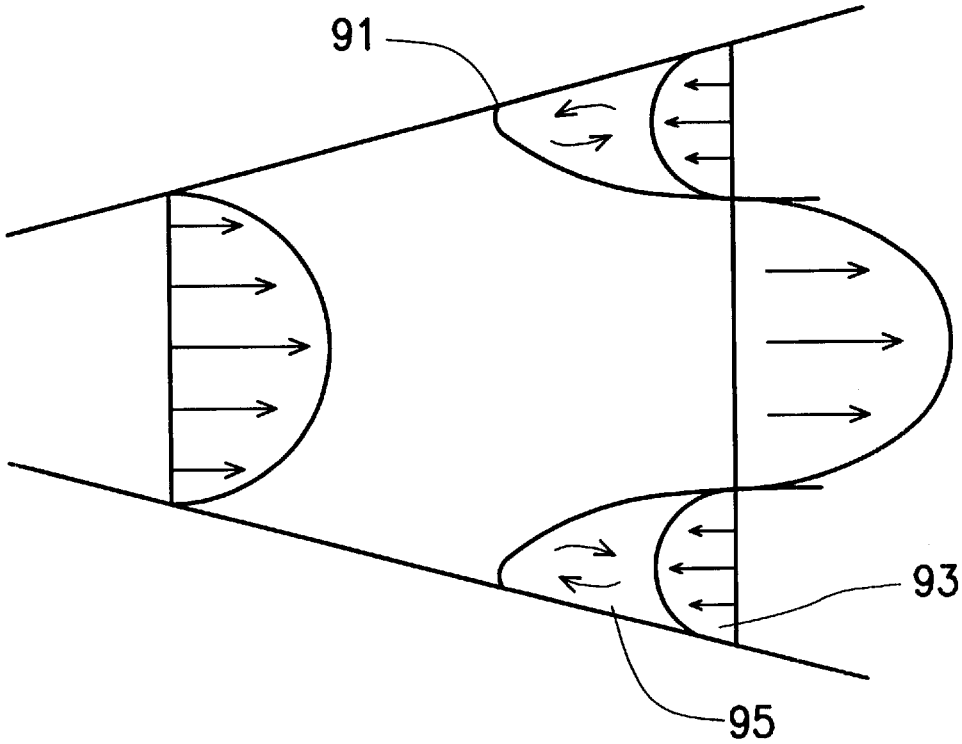
Figure 10:
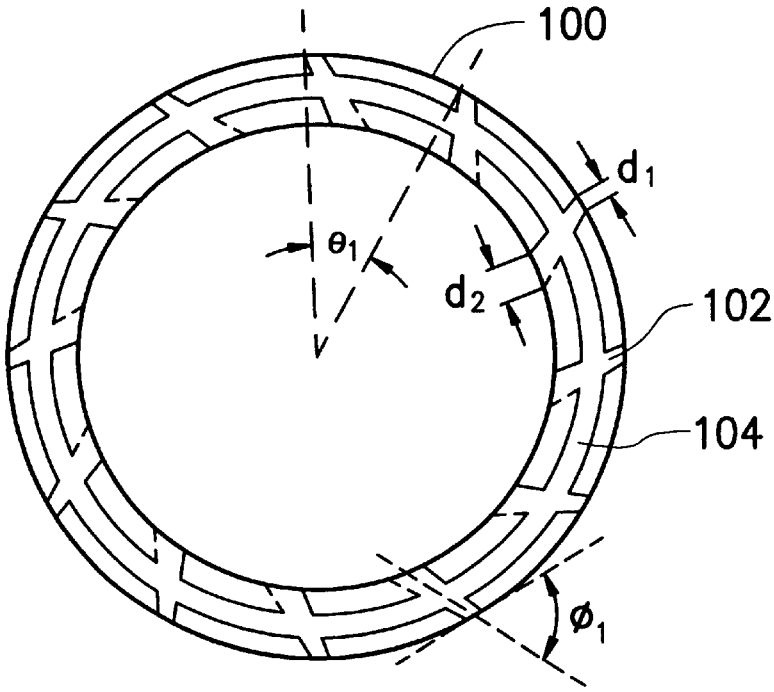
FIG. 10 is a schematic top view of a fourth embodiment of the retainer ring according to the invention.

In FIG. 9C, a slurry passage with a narrow inlet and a wider outlet is shown. That is, the slurry passage has a larger cross section area of the inner end than the outer end. With this design, the path of the slurry flow is gradually expanded, and the positive pressure gradient and the diversion of the slurry flow are moderated. The slurry supplied through the slurry passage is thus increased. As shown in the figure, $P_1$, $A_1$ and $V_1$ represent the pressure and cross section area of the inlet, and the flow rate of slurry flow at the inlet, respectively. Whereas, $P_2$, $A_2$ and $V_2$ represents the pressure and cross section area of the inlet, and the flow rate of slurry flow at the outlet, respectively. Considering the fiction between the slurry and the slurry passage and the gravitation of the slurry are negligible and the slurry is incompressible. If the diffusion angle is $\phi_2$ and l is the passage length, the Bernoulli equation can be employed by ignoring the vortex of the slurry flow at the inlet, the barrier at the outlet, and any external vibration:

$$P + \frac{1}{2}\rho V^2 = P_0 = const. \tag{4}$$

wherein P is the pressure, ρ is the density, and V is the velocity of the flow, and $P_0$ is the stagnation pressure. By introducing equation (4), the resilience coefficient of pressure $C_P$ is:

$$C_P = \frac{P_2 - P_1}{P_0 - P_1} = 1 - \frac{P_0 - P_2}{P_0 - P_1} = 1 - \left(\frac{V_2}{V_1}\right)^2 \tag{5}$$

From the continuity equation:

$$A_1V_1 = A_2V_2 \tag{6}$$

The resilience coefficient of pressure can be obtained as:

$$C_P = 1 - \left(\frac{A_1}{A_2}\right)^2 \quad (7)$$

Therefore, the higher $C_P$ is, the larger $A_1/A_2$ is. Moreover, the larger the value of $A_1/A_2$ is, the wider the diffusion angle $\phi_2$ is, and the slurry flow is expected to be more fluent. However, as the diffusion angle $\phi_2$ is increased over 10°, an effect of flow diversion 91 or a flow with a stall speed 93 is induced. Moreover, an inverse flow 95 can be caused, so that the across area is reduced.

By the above discussions, to design the slurry passage, one should consider the factors: (1) $\tan\phi_2$, (2) $\tan\phi_2<10°$, and (3) $A_2/A_1$. A retainer ring 80 with an outer diameter of 25.40 cm and an inner diameter of 22.86 cm, referring to FIG. 8A, the diameter $d_1$ of the outer cross sectional area of slurry passage 82 is about 1 cm. Whereas, the diameter $d_2$ of the inner cross sectional area of the slurry passage 82 is about 1.8 cm. The central angle $\theta_1$ between two neighboring slurry passages 82 is about 30°, and the diffusion angle $\theta_2$ of each slurry passage is about 30°.

Fourth Embodiment

FIG. 5A is a schematic top view of the fourth embodiment of the retainer ring 100 according to the invention. The design of the slurry passages 102 of the retainer ring 100 in this embodiment is identical to the third embodiment. These slurry passages 102 are in a form of substantially equally spaced grooves with a larger cross section in the inner end and a smaller cross section in the outer end, that is, a larger outlet and a smaller inlet. Each of these slurry passages 102 is oriented formed in a similar manner as the previous embodiment. Again, the width and depth of the slurry passages 102 depends on the specific requirements for the polishing process. That is, the dimensions of the slurry passages 102 has to be determined by the factors: (1) $\tan\phi_2$, (2) $\tan\phi_2 \leqq 10°$, and (3) $A_2/A$ which have been introduced in the third embodiment. In this embodiment, at least one circular path 104, for example, a circular groove, tube, channels, or guiding hole, is formed at the bottom surface of the retainer ring 100 between the outer perimeter and inner perimeter of the retainer ring 100, intercrossing all of the straight grooves 102. The circular path 104 is functioned as a buffer ring. The slurry being drawn in through the slurry passages 102 is partly buffered and circulating in the circular path 104, thus allowing those edge portions of the wafer proximate to the inner ends of the slurry passages 102 to receive only a part of the slurry. Thus, the polished effect obtained from the previous embodiment, that is, an evenly and uniformly planarized surface of the wafer, is obtained without forming thinner edge portions. The circular path 104 has a similar dimension of the slurry passages 102.

Fifth Embodiment

In semiconductor technique, chemical mechanical polishing is the only technique which can achieve a global planarization so far in the fabrication process of a very- or ultra-scaled integrated circuit. The CMP process can be applied in many fabrication process, for example, to planarize an uneven surface on a semiconductor substrate to advantage the subsequent process, for example, to obtain a precise alignment in the following photolithography etching process. Examples of fabricating a semiconductor device by using CMP is drawn and described in the following paragraph.

Figure 11A:
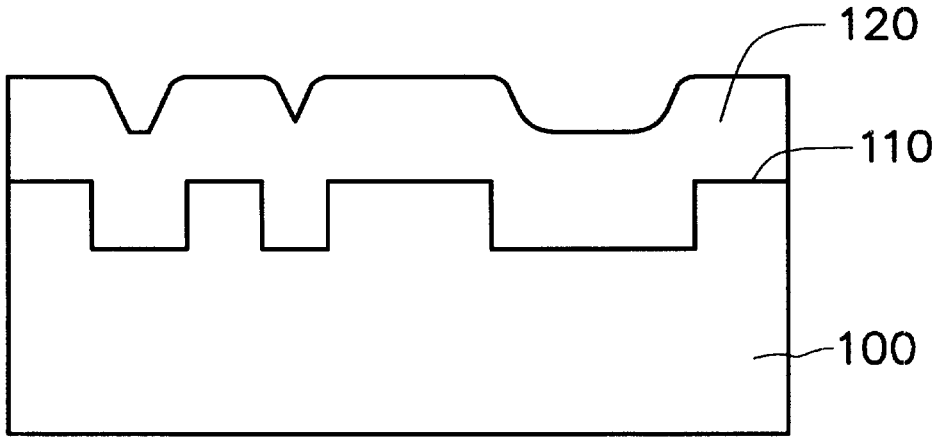
FIG. 11A to FIG. 11B show cross sectional views of the process for planarizing a deposition layer on a wafer.
Figure 11B:
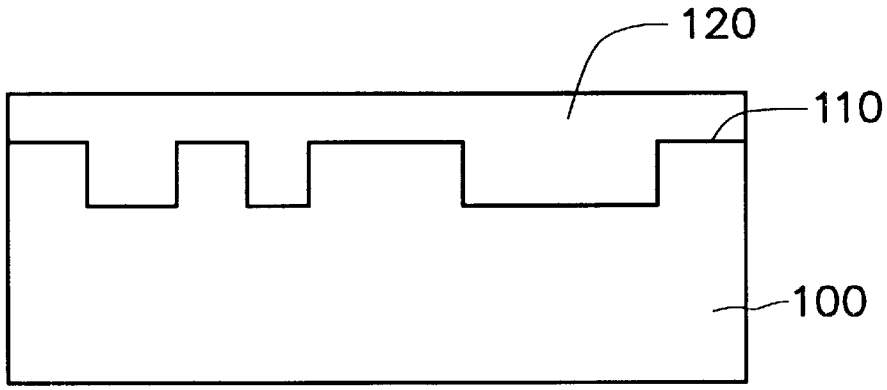

In FIG. 11A, a semiconductor substrate 100 having an uneven surface 110 is provided. On the semiconductor substrate 100, a deposition layer 120 is formed. The deposition layer 120 is consequently formed with uneven surface due to the uneven surface 110 underlying. In this invention, a CMP machine comprising the retainer ring with slurry passages is used. The CMP machine comprises a polishing table, a polishing head facing the polishing table, and a slurry supply which supplies slurry on the polishing table for polishing. The retainer ring is disposed at the bottom edge of the polishing head. With the surface of the deposition layer 120 facing the polishing table, the semiconductor substrate 100 is disposed within the polishing head and retained by the retainer ring. The deposition layer 120 is thus planarized. It has to be noted that with the conventional CMP machine, due to the unevenly distributed slurry, the deposition layer 120 can not be planarized with an even surface as expected. By conducting the slurry through the slurry passages of the retainer ring, or even through the circular path, the slurry is evenly distributed over the wafer surface, that is, the surface of the deposition layer 120, a uniformly planarized surface can be obtained as shown in FIG. 11B.

Figure 12A:
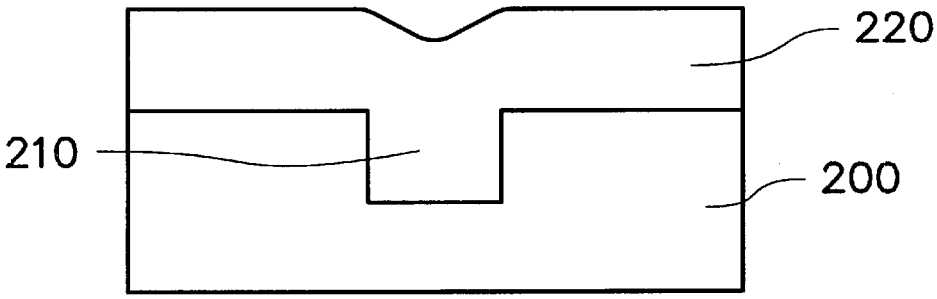
FIG. 12A to FIG. 12B are cross sectional views showing an etch back process.
Figure 12B:
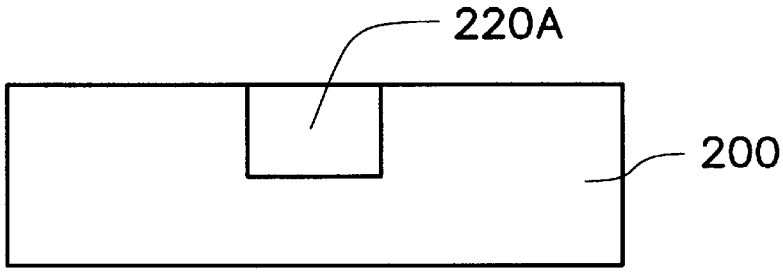

The CMP process can also be applied for etch back, for example, to form a plug. In FIG. 12A, a substrate 200 having an opening 210 is provided. A deposition layer 220 is formed on the substrate 200 and to fill the opening 210. To form a plug within the opening, the deposition layer 220 is then etched back. Very often, a CMP process is performed for the etch back process. By using a CMP machine with the retainer ring introduce in the invention, a plug 220A with a very uniformity is formed as shown in FIG. 12B.

Figure 13A:
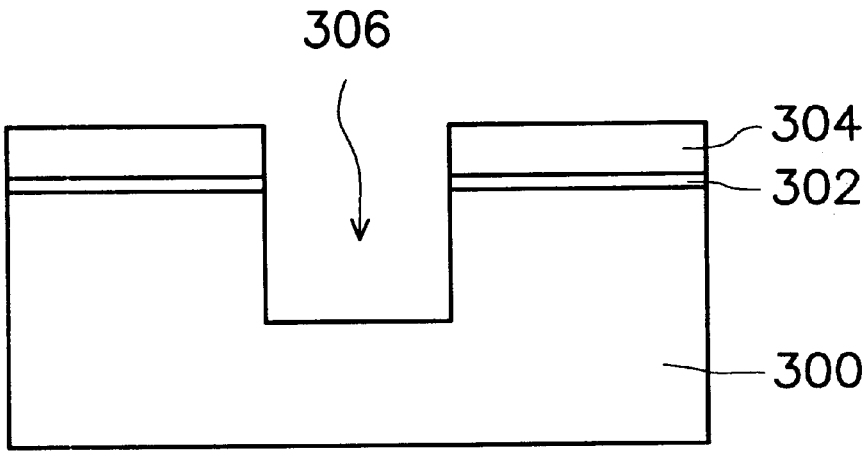
FIG. 13A to FIG. 13D are cross sectional views showing a method of fabricating a shallow trench isolation by using the chemical mechanical machine provided in the invention.

Another specific and widely used application for CMP process is the fabrication of a shallow trench isolation. A method of forming a shallow trench isolation is shown as FIG. 13A to FIG. 13D. In FIG. 13A, a pad oxide layer 302 with a thickness of about 100 Å to 150 Å is formed on a substrate 300, preferably, a silicon wafer. A mask layer 304, for example, a silicon nitride layer with a thickness of about 1000 Å to 3000 Å is formed to cover the pad oxide layer 302. Etching through the mask layer 304, the pad oxide layer 302, and the substrate 300, a trench 306 is formed with a depth of about 0.5 $\mu$m.

Figure 13B:
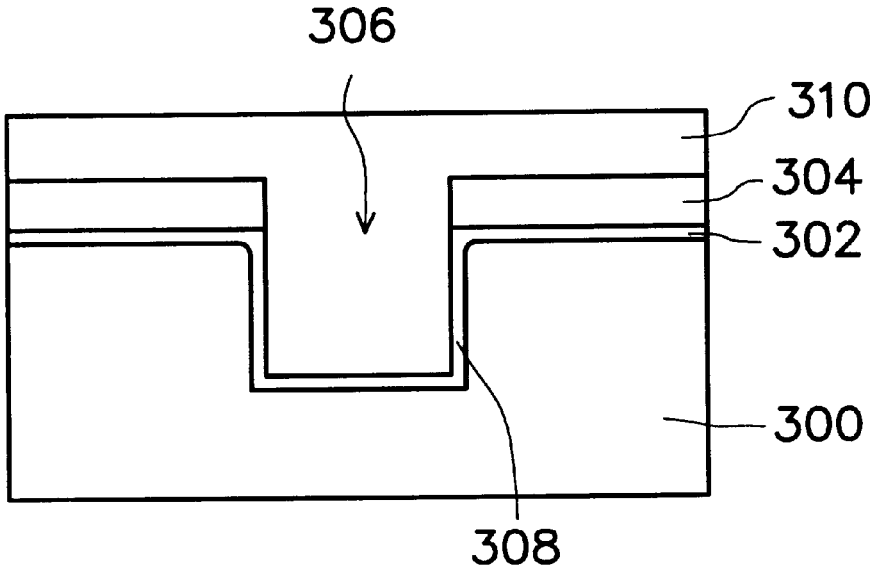

In FIG. 13B, along side walls of the etched trench 306, a liner oxide layer 308 is formed with a thickness ranging from about 150 Å to 200 Å. An insulation layer 310 is formed to cover the mask layer 304 and to fill the trench 306. Preferably, the insulation layer 310 is formed with a thickness of about 9000 Å to 11000 Å. Typically, a densification usually follows to obtain an improved the structural quality.

Figure 13C:
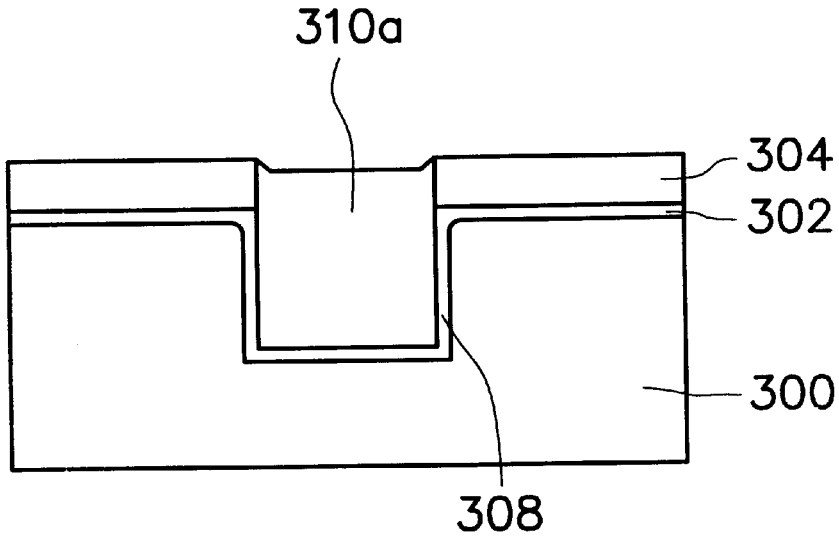
Figure 13D:
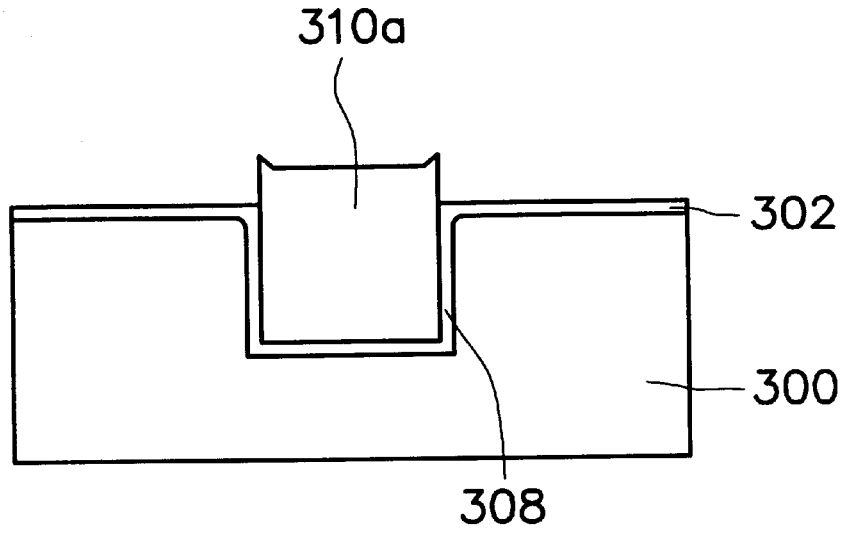

In FIG. 13C, using the mask layer 304 as a stop layer, the insulation layer 310 shown in FIG. 13B is polished form an insulation plug 310*a* by a CMP process. By using a conventional CMP machine, since the slurry can not be supplied evenly distributed over the surface of the insulation layer 310, the particles contained within the slurry causes micro-scratches or other defects. With the formation of these micro-scratches and defects, in the subsequent process, a bridging or electrically short effect is likely to occur. The yield of products is degraded.

In the invention, a CMP machine having a retainer ring with slurry passages is provided. The substrate 300 is retained within the retainer ring with slurry passages. While polishing, the insulation layer 310 (FIG. 13B) is facing down to a polishing pad on a polishing table of the CMP machine to form an insulation plug 310*a* as shown in FIG. 13C. Since the polishing slurry is supplied evenly and uniformly distributed over the insulation layer 310, so that the insulation plug 310*a* is formed with a uniform structure without micro-scratches or defects. Using a conventional method, the mask layer 304 is removed, so that the shallow trench isolation is formed.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A chemical mechanical polishing machine, comprising:

a polishing table;

a polishing pad on the polishing table;

a slurry supplier, to supply slurry onto the polishing table for polishing a wafer;

a polishing head, to dispose the wafer therein; and a retainer ring, at the bottom edge of the polishing head to retain the wafer, wherein the wafer is retained by the retainer ring with its surface to be polished facing the polishing pad; and the retainer has a plurality of slurry passages to direct the slurry supplied by the slurry supplier through the retainer ring over the surface of the wafer, and the slurry passages are radially declined from an inner perimeter to an outer perimeter and each of the slurry passages has an acute angle of attack against the slurry flow outside the polishing head while the polishing head is spinning for polishing.

2. The chemical mechanical polishing machine of claim 1, wherein the retainer ring has an inner diameter larger than 4 inch.

3. The chemical mechanical polishing machine of claim 1, wherein the slurry passages are each formed with a width of 0.05~0.3 mm and a depth of 2~4 mm.

4. A chemical mechanical polishing machine, comprising:

a polishing table;

a polishing pad on the polishing table;

a slurry supplier, to supply slurry onto the polishing table for polishing a wafer;

a polishing head, to dispose the wafer therein; and a retainer ring, at the bottom edge of the polishing head to retain the wafer; wherein:

the wafer is retained by the retainer ring with its surface to be polished facing the polishing pad; and the retainer ring further comprises:

a plurality of slurry passage to direct the slurry supplied by the slurry supplier through the retainer ring over the surface of the wafer; and a circular path intercrossing the slurry passages between an inner perimeter and an outer perimeter of the retainer ring.

5. The chemical mechanical polishing machine of claim 4, wherein the slurry passages substantially equally spaced.

6. The chemical mechanical polishing machine of claim 4, wherein the slurry passages are radially declined in a way to form an acute angle of attack against the slurry flow outside the retainer ring.

7. The chemical mechanical polishing machine of claim 4, wherein the retainer ring has an inner diameter larger than 4 inch.

8. The chemical mechanical polishing of claim 4, wherein the slurry passages are each formed with a width of 0.05~0.3 mm and a depth of 2~4 mm.

9. The chemical mechanical polishing of claim 4, wherein said circular path is formed with a width of 0.05~0.3 mm and a depth of 2~4 mm.

10. A chemical mechanical polishing machine, comprising:

a polishing table;

a polishing pad on the polishing table;

a slurry supplier, to supply slurry onto the polishing table for polishing a wafer;

a polishing head, to dispose the wafer therein; and a retainer ring at the bottom edge of the polishing head to retain the wafer, wherein the retainer ring has a plurality of slurry passages to direct the slurry supplied by the slurry supplier through the retainer ring over the surface of the wafer, and the slurry passages are designed in such a way with a gradually expanding path for slurry from an outer perimeter to an inner perimeter of the retainer ring.

11. The retainer ring in claim 10, wherein the slurry passages further comprises a circular path intercrossing the slurry passages between an inner surface and an outer surface of the retainer ring.

12. The chemical mechanical polishing machine in claim 10, wherein the slurry passages are designed with a diffusion angle between 0° to 10°, and an angle of attack $\phi_1$ calculated from the equation:

$$\sin\phi_1 = \frac{x}{l}$$

wherein the x is the minimum distance between a tangent line of an inlet point and a tangent line of an outlet point, and l is a path length of each of the slurry passages.

13. The retainer ring in claim 10, wherein the slurry passages further comprises at least one circular path intercrossing the slurry passages between an inner surface and an outer surface of the retainer ring.

* * * * *